US005579796A

United States Patent [19]

Mallo et al.

[11] Patent Number: 5,579,796

[45] Date of Patent: Dec. 3, 1996

[54] AUTOMOBILE SHELTER STRUCTURE

[76] Inventors: Mark D. Mallo; Gail M. Mallo, both of 6326 Duval Dr., Margate, Fla. 33063

[21] Appl. No.: 573,486

[22] Filed: Dec. 15, 1995

[51] Int. Cl.[6] ..... E04H 15/06

[52] U.S. Cl. ..... 135/88.06; 135/88.05; 135/88.01; 135/90; 135/117; 52/63

[58] Field of Search ..... 5/110; 135/88.01, 135/88.05, 88.06, 90, 117, 114, 115, 128, 148, 157, 120.3, 143; 296/136, 95.1; 52/63

[56] References Cited

U.S. PATENT DOCUMENTS

| | | | |
|---|---|---|---|
| 2,591,551 | 4/1952 | Kaplan | 5/110 |
| 3,133,549 | 5/1964 | Severing | 135/120.3 X |
| 4,164,233 | 8/1979 | McAndrew | 135/114 X |
| 4,605,030 | 8/1986 | Johnson | 135/148 X |
| 4,683,902 | 8/1987 | Wilson | 52/63 X |
| 4,834,128 | 5/1989 | Burgess | 135/88.06 |
| 4,886,083 | 12/1989 | Gamache | 135/88.06 |
| 4,944,321 | 7/1990 | Moyer-Ortiz | 135/95 X |
| 5,094,257 | 3/1992 | Wilson et al. | 135/148 X |
| 5,167,246 | 12/1992 | Mortenson | 135/143 X |
| 5,241,977 | 9/1993 | Flores et al. | 135/88.06 |

FOREIGN PATENT DOCUMENTS

| | | | |
|---|---|---|---|
| 0065748 | 2/1969 | Germany | 135/88.06 |

*Primary Examiner*—Wynn Wood
*Attorney, Agent, or Firm*—McHale & Slavin, P.A.

[57] ABSTRACT

This invention relates generally to a portable shelter for an automobile which is lightweight and easily assembled. The invention utilizes base plates which are adjustably placed under the wheels of the sheltered vehicle for securely anchoring the shelter structure. Independently adjustable vertical support bars are attached to the base plates and support a canopy. Additionally, cross-braces which are adjustable in height and adjustable in length are positioned at tire height to that the vertical support bars of the structure can be securely braced against the vehicle tires. This provides superior lateral support against meteorological conditions without the need for external stakes or guide wires, and without contacting or damaging the body of the vehicle.

20 Claims, 8 Drawing Sheets

AUTOMOBILE SHELTER STRUCTURE

FIELD OF THE INVENTION

This invention is related to shelters and in particular to a portable shelter having a particular application in the form of sheltering automobiles.

BACKGROUND OF THE INVENTION

The automobile is currently the preferred mode of transportation throughout the world. The internal combustion engine has provided self contained transportation that has liberated the way Americans work by eliminating the need for proximity placement to employers or family. Since the turn of the century, automobiles have been perfected to the point that nearly four hundred million cars are now operating throughout the world with nearly one-third of those automobiles placed in the United States alone.

Modern gas powered vehicles are an efficient and enjoyable means of travelling. Moreover, battery powered and other alternatively powered vehicles are also proving to be popular, economical, and efficient. For this reason, it is not uncommon for a family to own two automobiles which may equal or exceed the price of a home. In fact, the automobile is generally rated as the second most expensive item purchased by an individual, after the home. In addition, many such automobiles are collectibles, wherein their values are constantly increasing or are considered priceless in light of their vintage.

The styling of automobiles lends itself to individuality with owners taking great pride in maintaining their automobiles further enhancing the automobile's collectability. Collectable vehicles are often stored or placed on display for the public to view. In this manner, a number of display opportunities may include the use of collector shows, wherein fellow collectors may view each other's work or allow the public to admire the prized possessions.

One of the greatest advantages of the automobile, namely mobility, also leads to a disadvantage of being subjected to the elements. Automobiles are subjected to all of nature's elements such as rain, hail, snow, ice, salt, and most commonly sunlight. The cosmetic appearance of the automobile is enhanced by the use of high quality paints, however, such paints can be easily damaged by repeated subjection to sunlight, acidic rain (e.g. rain which has picked up airborne pollutants), and so forth. In many instances, the automobile can not be moved quickly enough to avoid unpredictable elements such as hail. During car shows, it is preferable to view an automobile on a sunny day. However, the sunlight affects the paint, interior and may even mollify rubber components. Simple airborne contaminants that settle on the car can eventually damage the surface of the car if the grit is not removed before causing an abrasion to the automobile's surface.

In this manner, various portable shelters are in the public domain, but are seldom used as their portability allows them to easily collapse which may damage an automobile. For example, a improperly constructed shelter may collapse or can simply be dislodged from its position when subjected to a light breeze, thus damaging the automobile. Should that breeze intensify, a shelter structure, such as a tent, may easily be blown away from the vehicle causing damage to other property or automobiles in the immediate vicinity. For this reason, such structures may include various means for securing the structure to the ground such as the use of stakes. A stake may encompass a rope tied to a portion of the structure, wherein the stake is placed a distance from the structure to provide lateral stability. A problem with staking is it requires sufficient staking room and the stakes must be driven into the ground. It is impractical to drive such stakes into asphalt or cement parking surfaces. Stakes can be injurious to the visiting public if the stakes are not properly identified, wherein an individual may trip over the stake or walk into the guide wire. In addition, if the stake is not properly secured, it will provide nothing more than a false sense of security as a fluctuating breeze may easily dislodge the shelter. If the stake is improperly positioned, the structure will, in all probability, collapse as if no stake was provided.

The need for sheltering of automobiles is not limited to show or display situations as automobile owners throughout the world may not have access to parking garages when the automobile is not in use. Frequently, such automobiles are placed in a driveway, or a parking lot while the individual is at work, and so forth. In those instances, the automobile again remains subject to the elements. Moreover, while the average automobile owner may not have the same level of investment or daily expenditures that a collectable automobile owner may have, the automobile nevertheless represents a sizeable investment to the owner. Clearly, it is most advantageous for the owner to maintain the automobile in superior condition so as to provide the highest resale value, thus minimizing damage to their investment. An automobile parked in a driveway may be subjected, for instance, to rains or a heavy dew or even a snowfall during the night, all of which will eventually damage the surface of the automobile.

The automobile owner may desire to wash the automobile during the daylight hours, wherein direct sunlight can often be magnified by the washing materials and can actually cause damage despite the best intentions of the automobile owner to clean the vehicle. Sunlight is also a problem when the finish of an automobile is to be waxed as most waxes should not be applied in direct sunlight. In those instances, the automobile owner may have to locate a covered shelter or wait for an overcast day before applying a protective coating to the automobile finish.

What is lacking in the art is a self-contained portable automobile shelter that can be easily transported and assembled so as to protect an automobile from the elements, yet provide a secure structure that will not cause damage to the protected automobile, or to other automobiles in the immediate vicinity.

SUMMARY OF THE INVENTION

The instant invention is a self-contained portable automobile shelter structure. The shelter structure is constructed from a lightweight frame which is assembled into a substantially rectangular structure for securing an opaque fabric in a planar position. In the most basic embodiment, the shelter structure is positioned in a horizontal plane above the automobile by the use of four adjustable support poles releasably secured to the framing structure. The support poles incorporate a base which is placed beneath the automobile's tires, wherein the weight of the automobile maintains the structure in an upright rigid manner. In addition, a tire support is located along the length of each support pole for positioning against the automobile tire or wheel. In this manner, each support pole is secured by the weight of the automobile and further reinforced by the second support providing a two prong attachment.

The structure is stored in a flexible utility bag that can be placed in the automobile's trunk. When the support is to be erected, the components are removed from the storage bag, wherein the support structure is assembled by coupling the support rails in a manner so as to stretch the fabric into a rectangular position. The support poles are then secured to the structure rails and the structure raised to a preferred height, preferably, by telescoping support poles. The automobile is then driven beneath the structure, onto the support bases placed at the base of each support pole. Each support pole is then secured by use of a spanner attachment which is pressed against the upper portion of the tire or secured directly to the wheel.

The result is a structure capable of providing shade for the automobile, as well as protection from the elements such as rain, snow, hail, and so forth. The telescoping poles allow the height of the structure to be raised or lowered. Unequal heights provide for a tilting for those instances where heavy precipitation is expected so as to prevent accumulation of rain or snow directly on the upper portion of the support structure. The fabric may be a lightweight nylon, canvas, or any other type of material that provides sheltering and may further be waterproofed or of sufficient strength so as to accommodate heavy loading.

Thus, an objective of the instant invention is to provide a lightweight portable shelter for automobiles that can be securely positioned without the need for stakes and guide wires.

Yet another objective of the instant invention is to provide an automobile shelter that can be placed at various heights with a means for allowing tilting of the structure to accommodate directional elements such as the rising and setting sun, and/or wind-blown precipitation.

Still another objective of the instant invention is to provide a secondary support to prevent movement of the support poles for maintaining a fixed distance between from each automobile tire.

Still another objective of the instant invention is to disclose a sheltering device capable of accommodating any size automobile wheel base height.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms a specific embodiment with certain alternatives, it will be readily apparent to those skilled in this art that various modifications, rearrangements and substitutions can be made without departing from the spirit of the invention. The scope of the invention is defined by the claims appended hereto.

The present invention involves a portable apparatus which can be used to provide instant shielding of an automobile from various meteorological elements. The component parts of the shielding structure can be quickly constructed for ease of use and also quickly deconstructed and compactly stored for ease in transporting the device. The shielding apparatus is sturdy in construction and stable against windy conditions. To achieve this stability the sheltering device utilizes the weight of the vehicle to anchor the device. Additionally, the device provides adjustable cross-braces which mount against the vehicle's tires and prevent vertical supports from laterally swaying. Such braces vitiate the need for external staking of the shielding structure and prevent direct contact of the shielding apparatus with the automobile body.

Figure 1:
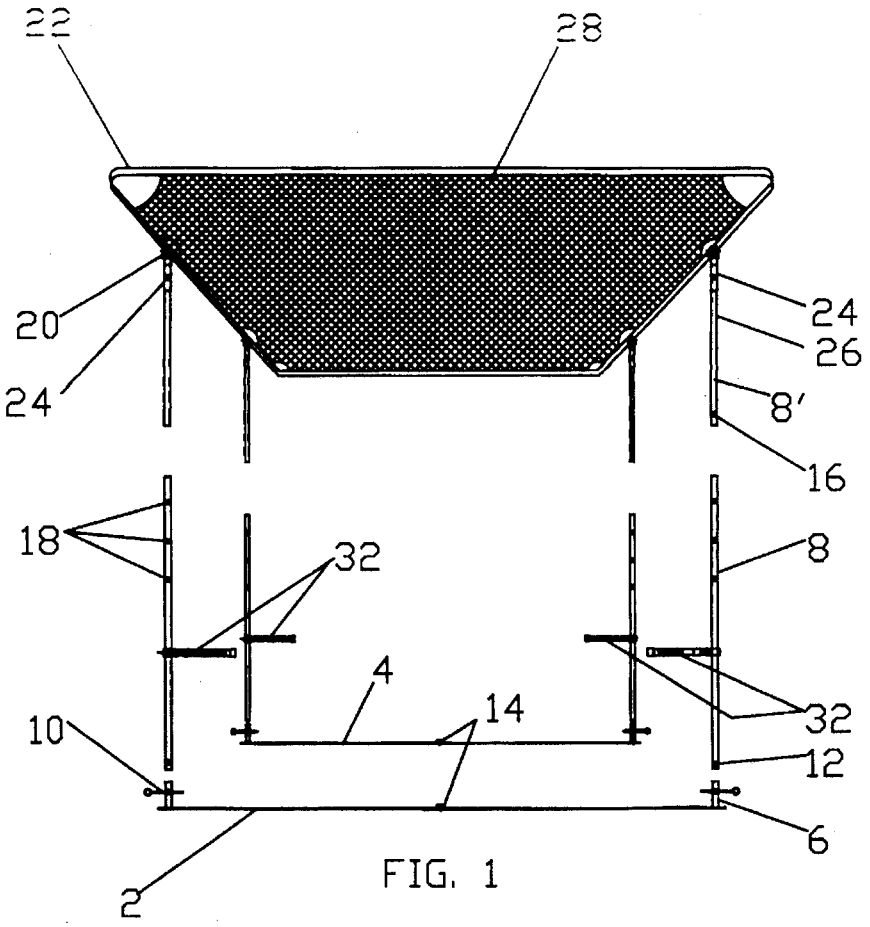
FIG. 1 shows a front view of an erected portable shelter with the support poles parts shown in exploded fashion.

Referring now to FIG. 1, a constructed example of the preferred embodiment is shown, but with various parts shown exploded for emphasis. The shielding device 1 includes two base support plates 2, 4 which are each formed from two component plates (See FIG. 3) joined together by a bolt/wingnut combination 14. Each base support plate includes two support posts 6. The support posts 6 might be affixed to the base support plate through a variety of attachment means, however, the preferred embodiment uses welding. Each support post 6 is vertically oriented to be inserted into the hollow end of a tubular vertical support bar 8. Alternatively, the post 6 might consist of a bracket with a cavity large enough to receive and encompass the support bar 8. The preferred embodiment uses four such tubular vertical support bars 8 which receive posts 6 in their tubular ends.

Each post 6 additionally includes a through hole 10 which aligns with a through hole 12 in the vertical support bars 8. Upon insertion of post 6 into bar 8, the holes 10 and 12 are aligned and a pin (not shown here, see FIG. 3) is placed through the common opening to releasably, yet securely anchor the post 6 with the bar 8. Each vertical support bar also includes a second tubular component 8' which is inserted into the upper part of component 8. Component 8' includes a spring loaded button 16 and component 8 includes a corresponding series of through holes 18. When component 8' is inserted into component 8 the depressed button will spring outward upon encountering a hole 18. By depressing button 16 and further sliding component 8' into or out of component 8, the overall vertical extension of each individual vertical support bar 8 and 8' can be easily adjusted.

Further mounted to the top of each vertical bar component 8' is a mounting fixture 20. This fixture 20 is used for attaching a shielding canopy frame 22 to the underlying support frame. Fixture 20 uses a similar spring loaded button 24 to releasably interact with a through hole 26 in the top portion of component 8'. Fixture 20 slidably attaches to a portion of the canopy frame 22 which is exposed from the fabric canopy 28. This slidable attachment allows adjustable placement of the vertical support bars and the attached base support plates.

Figure 2:
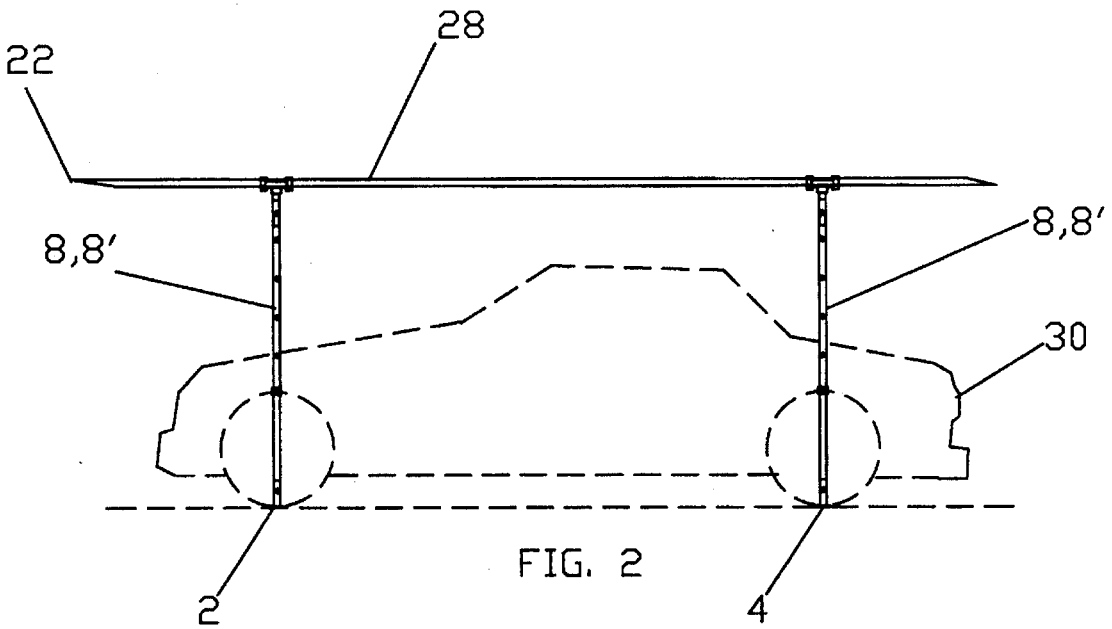
FIG. 2 shows a side view of automobile as parked under and protected by the portable shelter of FIG. 1.

Referring now to FIG. 2, a side view of the sheltering apparatus is shown with an automobile 30 in position. Due to the aforementioned slidable fixtures 20, the base plates 2, 4 are positioned so that they fall directly under the wheels of the automobile 30. Due to this arrangement, the entire weight of the vehicle serves to anchor the apparatus 1 from being disturbed by various meteorological conditions such as wind.

Referring again to FIG. 1, each vertical support bar 8 has a cross-support brace 32 which is adjustably attached at wheel level. This brace 32 butts up against the rubber of each tire to provide lateral stability to the shielding apparatus 1 without the use of external stakes. Moreover, by utilizing positional contact with the resilient tire, no permanent damage is done thorough contact of any shielding apparatus parts with the automobile body.

Figure 3:
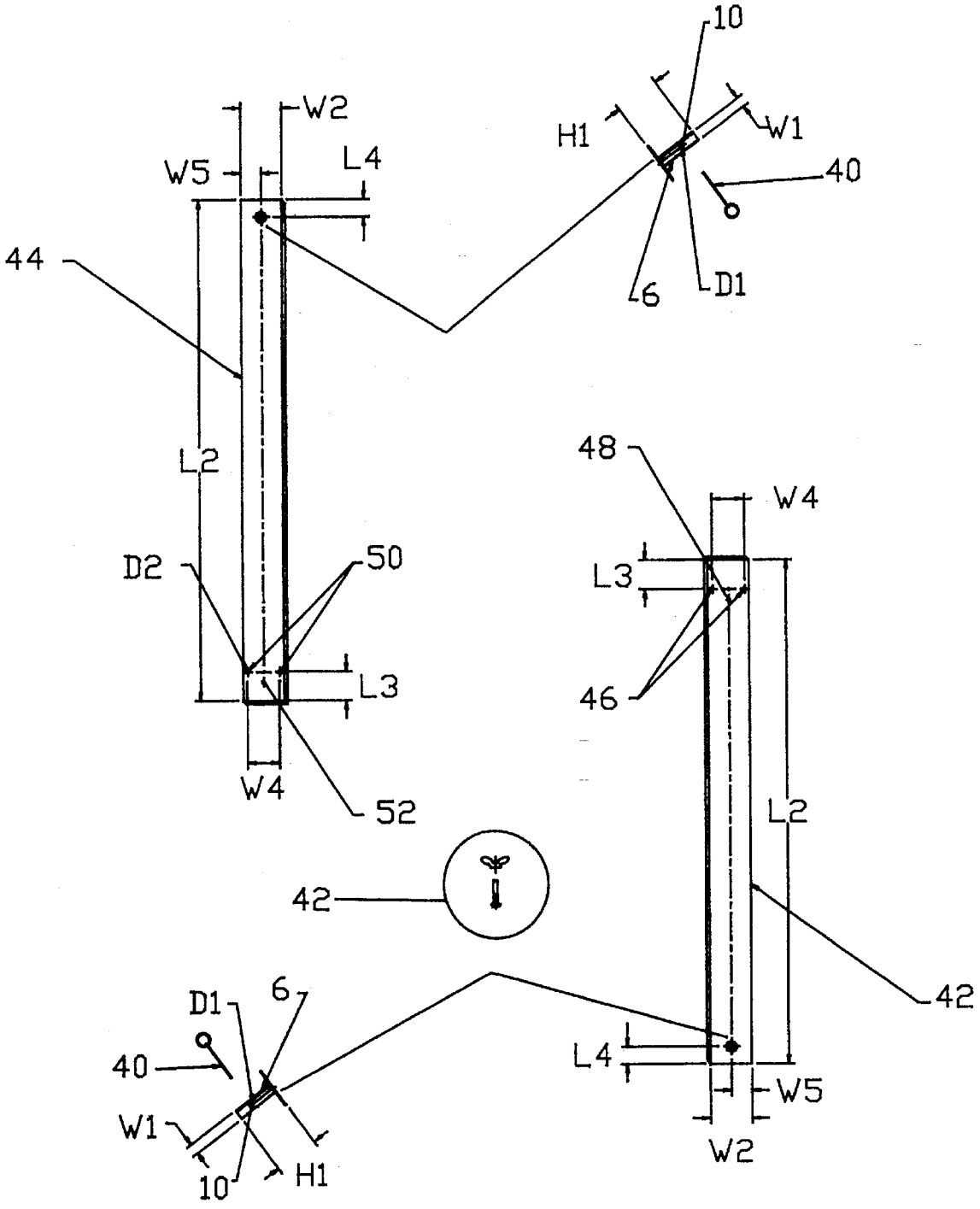
FIG. 3 shows an exploded view of one of the base support plates which are ultimately positioned under the tires of the sheltered vehicle.

Referring now to FIG. 3, a more detailed example of the base support plate 2 is shown (with plates 2 and 4 being substantially identical). Support plate 2 is comprised of two component sub-plates 42 and 44 each of which are of length L2 and width W2. At one end of each sub-plate the support post 6 is mounted a distance L4 from the end of the sub-plate. The support post 6 has a height H1 and a diametric width W1. The aforementioned through hole 10 which aligns with vertical bar hole 12 (not shown) has a diameter D1. The pin 40 would then be inserted through the aligned holes 10 and 12. Each support post 6 is attached to the sub-plate, and in this case the preferred embodiment uses welding.

The sub-plates 42 and 44 are attached together via a wingnut and bolt hardware attachment combination which joins together aligned holes in the sub-plates. At the end opposite to the mounted support post 6, the first sub-plate has a pair of through holes 46 which aligns with a similar pair of through holes 50 on the second sub-plate. The centerline of these holes are place a width W4 apart and the holes are located a distance L3 from the end of the sub-plate. A third (optional) hole (e.g. 48 aligning with 52) might also be used in each sub-plate for added stability. The holes each have a diameter D2. By overlapping the sub-plates, aligning the holes, and attaching wingnut and bolt combinations, the complete base support plate 2 is formed. As shown in FIG. 1, the bolt is inserted upwards through the holes and the wing nut is tightened from the top.

While any materials and measurements might be used, the preferred embodiment uses ⅛ inch aluminum stock for the plates because of its overall strength and light weight. The support post 6 is also aluminum and is attached via an aluminum weld. The other specific measurements used are as follows: L2=47.5 inches; W2=4 inches; W1=1 inch; H1=4.125 inches; L3=2.75 inches; L4=1.625 inches; W5=2 inches; D1, D2=0.25 inches. The bolt/nut are also sized at 0.25 inches to insure a secure fit between the joined parts.

Figure 4:
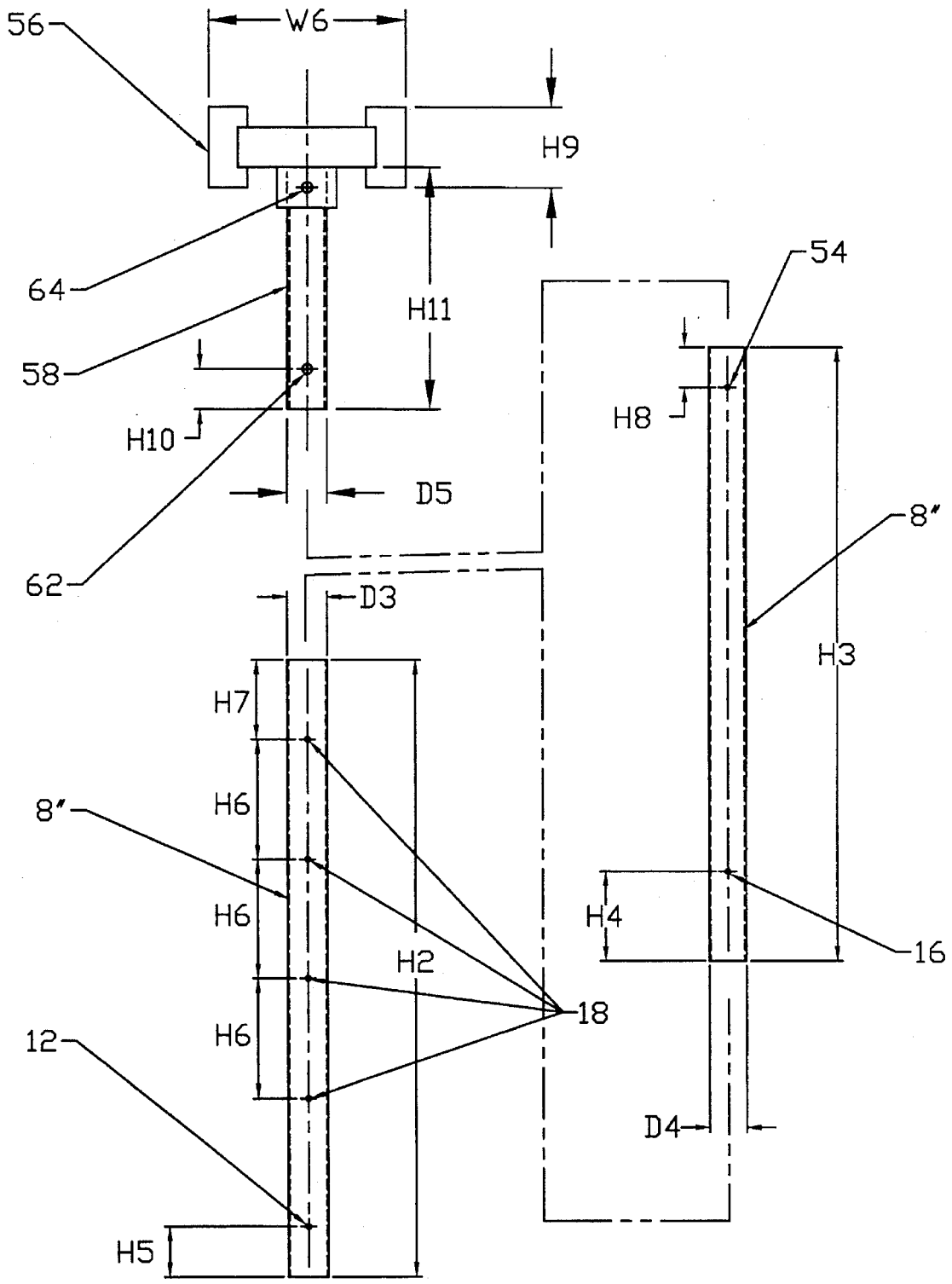
FIG. 4 shows an exploded view of one of the vertical support bars and one form of canopy fixtures used for attaching the shielding canopy to the base support plates.

Referring now to FIG. 4, a more detailed example of the vertical support bar is shown of which four are required for the completed shielding apparatus. The lower component 8 is a tubular member with a diameter D3 and extends a height H2 from top to bottom. The upper component 8' is a tubular member with a diameter D4 and extends a height H3 from top to bottom. With D4 being relatively smaller than D3, the tubular component 8' fits into the top of tubular component 8 so that it can slide in and out as required.

Component 8 has a series of holes 18, which penetrate only one side of the tubing which are spaced apart a distance H6 from each other, and with the first hole beginning a distance H7 from the top of component 8. At a distance H4 from its bottom end, component 8' has a corresponding spring loaded button 16 which extends outward from component 8'. When depressed, component 8' can be inserted inside of component 8 and freely slide up and down until the button 16 penetrates one of the holes 18. Upon penetration of the button into the hole, the components 8 and 8' are locked together in a secure, yet conveniently releasable arrangement. This telescopic arrangement of 8 and 8' allows the user to easily select and readjust the desired height of each individual vertical support bar combination 8 and 8'.

At a height H5 from its lower end, component 8 has the aforementioned through hole 12 which aligns with hole 10 of post 6 for penetration by pin 40 (as described above). At the opposite end of the support bar combination 8 and 8', a fixture is inserted for attaching the shielding canopy frame and canopy. As an alternative to the fixture 20 shown in FIG. 1, this fixture 60 uses a tubing 58 with a diameter D5 which is slightly larger than diameter D4 of component 8'. Tubing 58 has a hole 62 located a distance H10 from the bottom of the tube and penetrating one side of the tubing. Component 8' has spring loaded button 54 (similar to 16) located a distance H8 from the top of component 8'. Tubing 58 then slidably fits over the tubing of component 8' until the button 54 springs forward and penetrates hole 62. This arrangement securely, yet releasably, attaches the fixture 60 to the vertical bar component 8'.

The head 56 of the "tee" shaped fixture 6 is further attached to the tubing 58 via rivets 64 located on both sides of the tubing. The head 56 is mounted a distance H11 from the bottom of the tubing. The head 56 has a height H9 and a width W6 is oriented to slidably accommodate a tubular member of the canopy support frame.

Again, while a variety of materials might be used in constructing the vertical support bars of the shielding apparatus, the preferred embodiment uses aluminum tubular members for strength and weight considerations. Moreover, a variety of measurements might be effectively employed, but the preferred embodiment uses the following: H2=45.5 inches; H3=45.5 inches; H4=4.5 inches; H5=2.5 inches; H6=6 inches; H7=4 inches; H8=1 inch; H9=2 inches; H10=2 inches; H11=5 inches; W6=5 inches. The aluminum tubing has outside diameters of D3 and D5=1 inch, and D4=0.875 inches. With the aforementioned measurements, the combined components 8 and 8' have a maximum extended height of approximately 89 inches and a minimum extended height of approximately 68.75 inches. Also, with each vertical support being independently adjustable, the attached canopy can be adjusted to a variety of angles, slopes, and orientations depending of the shielding desired.

Figure 4A:
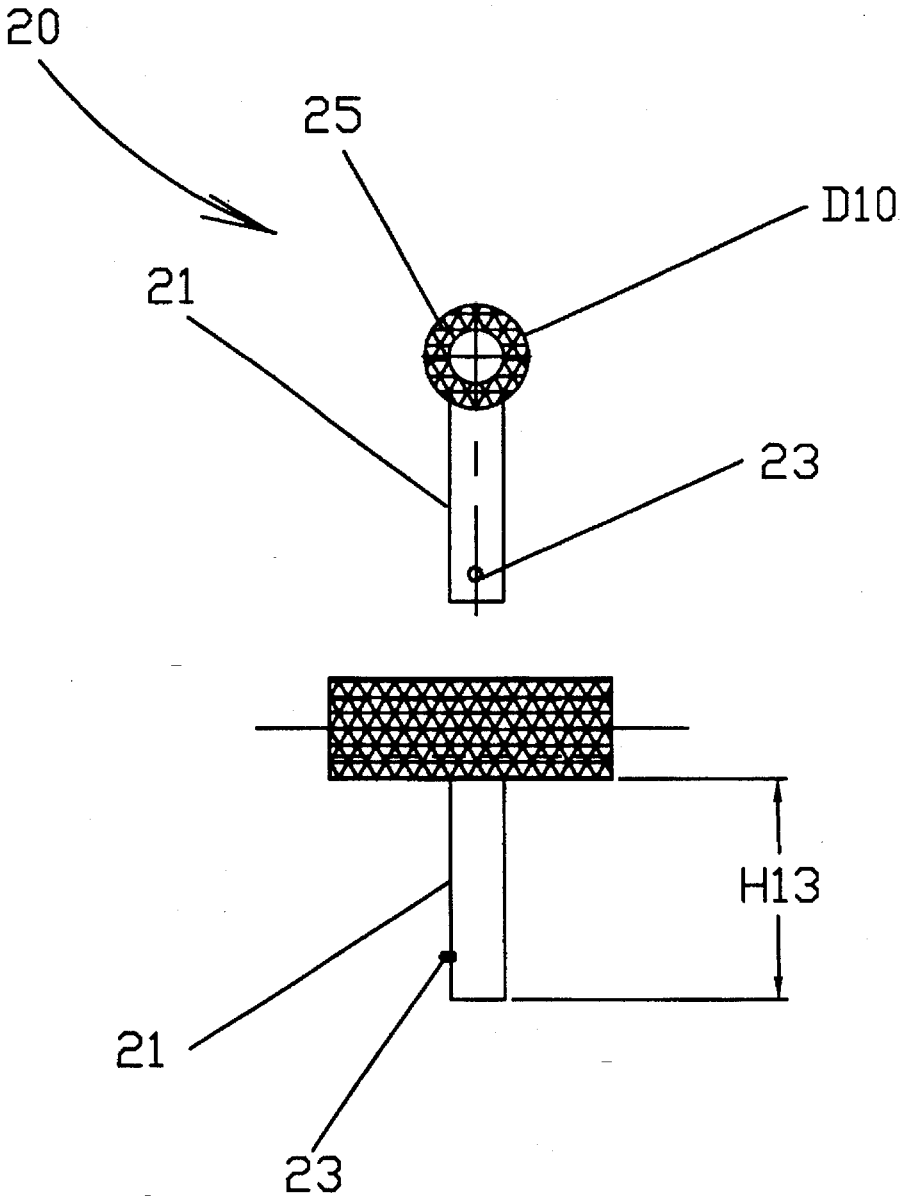
FIG. 4A shows a closeup of the type of canopy attachment fixtures as depicted in FIG. 1.

FIG. 4A depicts a type of canopy attachment fixture 20 which was shown in the embodiment of FIG. 1. Whereas fixture 60 had a tubular member 58 which was large enough to fit over vertical component 8', the tubular member 21 of fixture 20 would instead be smaller in diameter and fit inside the top end of vertical component 8'. As a result, fixture 20 would have a spring loaded button 23 which would encounter a hole 54' on component 8' instead of a button 54 (as shown in FIG. 4). Hence, the fixture could be releasably attached by depressing the button 23 and guiding it to encounter the hole 54'. The fixture 20 is "tee" shaped with a tubular member height of H13. The tubular shaped head 25 needs to have an inner diameter D10 which is larger than the tubular members of the canopy frame so that the fixture can slide along the canopy frame. This facilitates adjustment for the different wheelbase lengths of sheltered cars as further described above and below. The preferred embodiment utilizes a height H13=4 inches.

Figure 5:
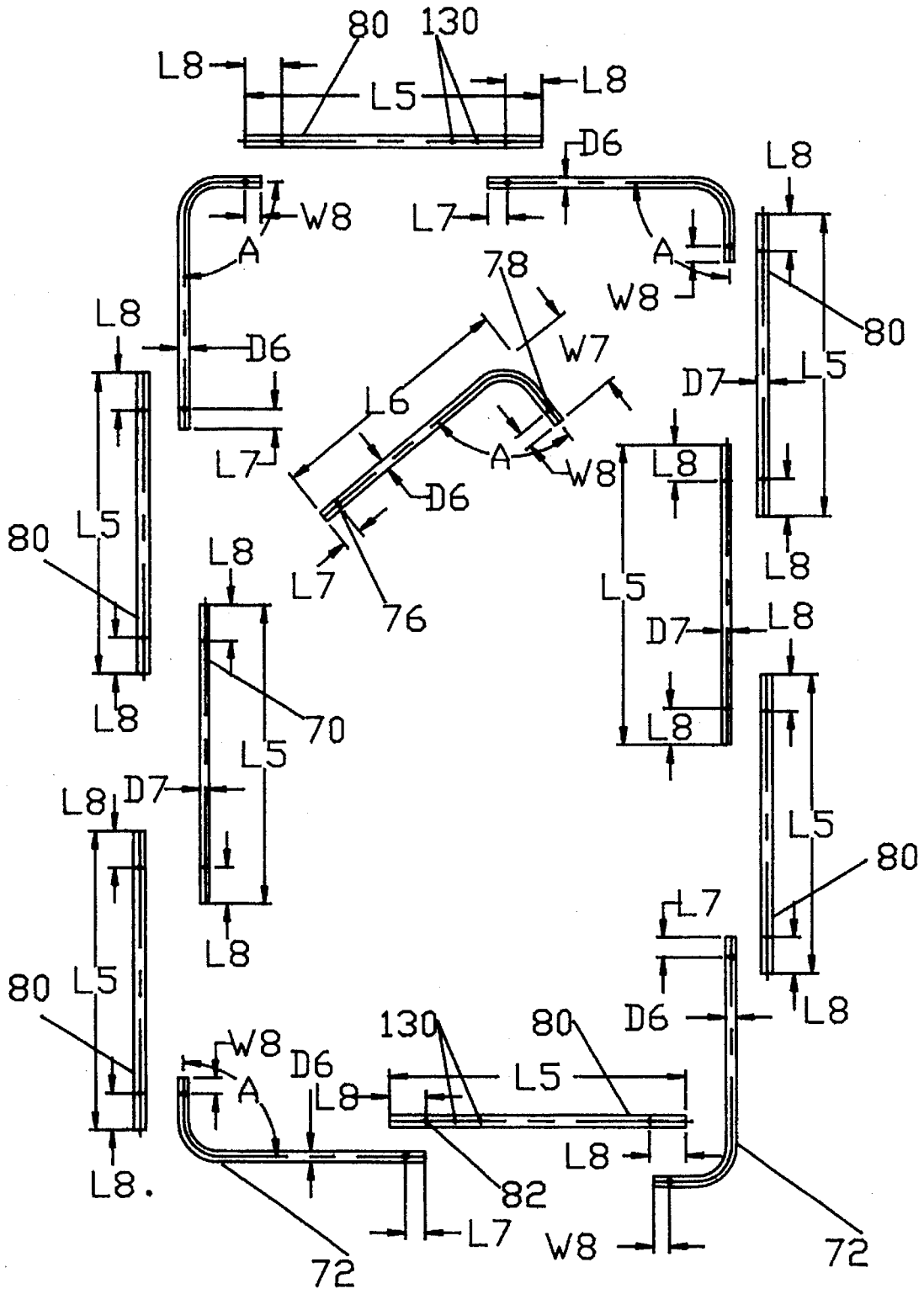
FIG. 5 shows an exploded view of the component parts used to form the shielding canopy frame.

Referring now to FIG. 5, the component parts of an example canopy frame are shown in exploded arrangement. While the assembled canopy frame is a relatively large object, it is important for portability that the frame can be disassembled into a collection of relatively small parts which can then be easily reassembled into the canopy frame. The present invention accomplishes this by using a series of redundant parts which interact with each other for easy transport and assembly. As shown, the construct uses tubular members of alternating diameters so that each alternating part will fit into (or over) the end of the next part. In this case, four (4) corner pieces 72 are used which have a length L6 and a width W7, and are oriented at a 90 degree angle A. The tubular member has an outside diameter of D6 and has a through hole 76 located a distance L7 from the lengthwise end and a through hole 78 located a distance W8 from the widthwise end. Additionally, six (6) lengthwise bar pieces 80 are used which have a length L5, an outside diameter D7, and have through holes 82 located a distance L8 from each end of the bar. Yet two (2) other lengthwise bar pieces 70 are used with a length L5, an outside diameter D6, and through holes 84 a distance L8 from each end of the bar.

The diameter D6 is slightly smaller than diameter D7 so that the D6 sized parts will fit into the ends of the D7 sized parts. Accordingly, each end of the D6 sized corner sections 72 fit into the D7 sized bars 80 as fitted to either end. The bars 80 then fit over D6 sized bars 70, and the bars 70 subsequently fit into the next set of D7 sized bars 80. As each D6 sized component is fitted into a D7 sized member, the through holes are aligned and an attachment means, such as a nut and bolt combination, or a locking pin, are employed to secure the two parts together.

Alternatively, the holes on the smaller D6 sized pieces might consist of spring loaded buttons as described above. Similarly, the holes on the D7 pieces would only penetrate one side of the tubular member. Accordingly, joinder of the D6 and D7 sized pieces would occur by depressing the button, sliding the D6 sized piece into the end of the D7 sized piece and positioning it to spring forward and penetrate the hole on the D7 piece. Again, this arrangement would provide a secure attachment of the alternating D6 and D7 pieces, but would also allow for quick release of the components upon disassembly. The holes and/or buttons are positioned at distances L7, L8, and W8 so as to provide enough penetration/interaction of the tubular members to insure stability.

Upon alignment and joinder of the eight lengthwise bar pieces and the four corner pieces, the canopy frame is formed. The preferred embodiment uses aluminum tubular members for strength and weight considerations. Again, while the invention could be effectively employed using a variety of measurements, the preferred embodiment of the canopy frame uses the following: A=90 degrees; L5=46 inches; L6=41 inches; L7=1.25 inches; L8=3 inches; W7=10 inches; W8=0.5 inches; D6 (outside diameter)=0.875 inches; and D7 (outside diameter)=1 inch.

While these joined tubular members provide a lightweight and easy to assemble embodiment, the frame might also be comprised of a variety of other collapsible and/or easily assembled components parts. For instance, the frame might include, but is not limited to, a series of hinged parts which fold out and lock into place via a pin, or a locking mechanism. Alternatively, the frame might include component parts which interlock via an "L" shaped guide path on one part for receiving a pin on another part, wherein the interfaced parts are twisted to lock the pin into the "L" cavity. Alternatively still, a special releasable bracket or clamp might link the component parts together. Moreover, non-tubular component parts, e.g. parts with square, hexagonal, triangular, or other geometric cross-sections, could also be effectively used.

Figure 6:
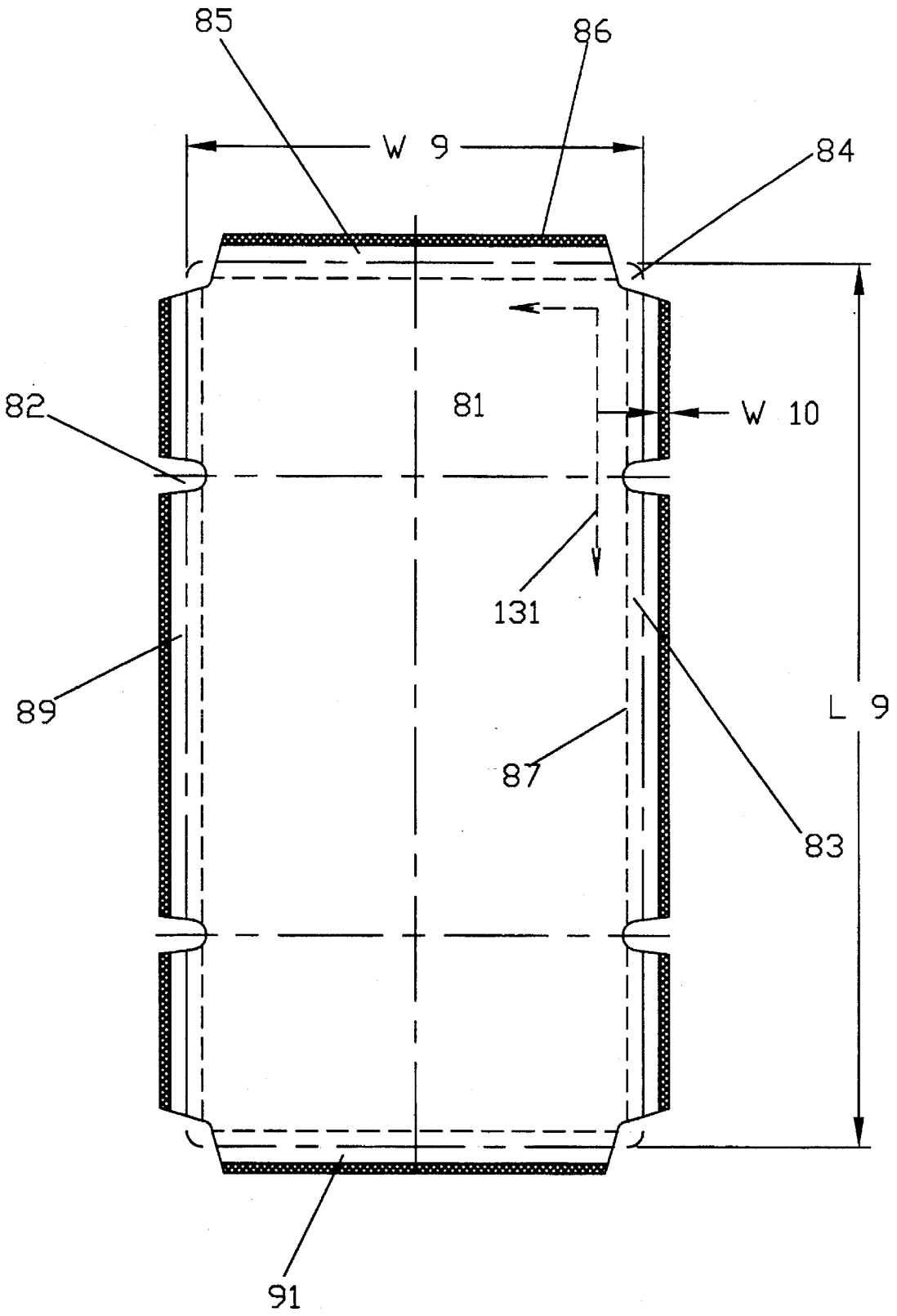
FIG. 6 shows an fabric canopy for attachment to a constructed canopy frame.

Referring now to FIG. 6, an example of a fabric canopy is shown which releasably attaches to the canopy frame. The fabric 81 includes cutouts 82 to accommodate attachment of the vertical support bars and fixtures to the canopy frame. These cutouts must be long enough to allow the fixture to adjustably slide along the canopy frame so as to accommodate a range of wheelbase lengths for positioning of the base support plates under the vehicle wheels. The fabric also includes cutouts 84 at each corner to facilitate easier attachment of the fabric to the frame, and to provide additional handholds for the moving the completed structure. The fabric is attached to the frame by the use of attached VELCRO strips 86 of width W10 which are preferably sewn onto the fabric. The fabric is attached to the canopy frame by wrapping each flap 83, 85, 89, and 91 around the frame tubing and affixing the VELCRO strip with a VELCRO receiving strip 87 attached along the inside perimeter.

While the fabric might consist of any material, a lightweight, waterproof, durable nylon is preferable. The preferred embodiment uses W10=2 inch wide VELCRO strips (or tape) sewn onto the canopy fabric. Also, the length L9=170 inches and the width W9=89 inches to fit the resulting size of the preferred frame measurements.

Figure 8:
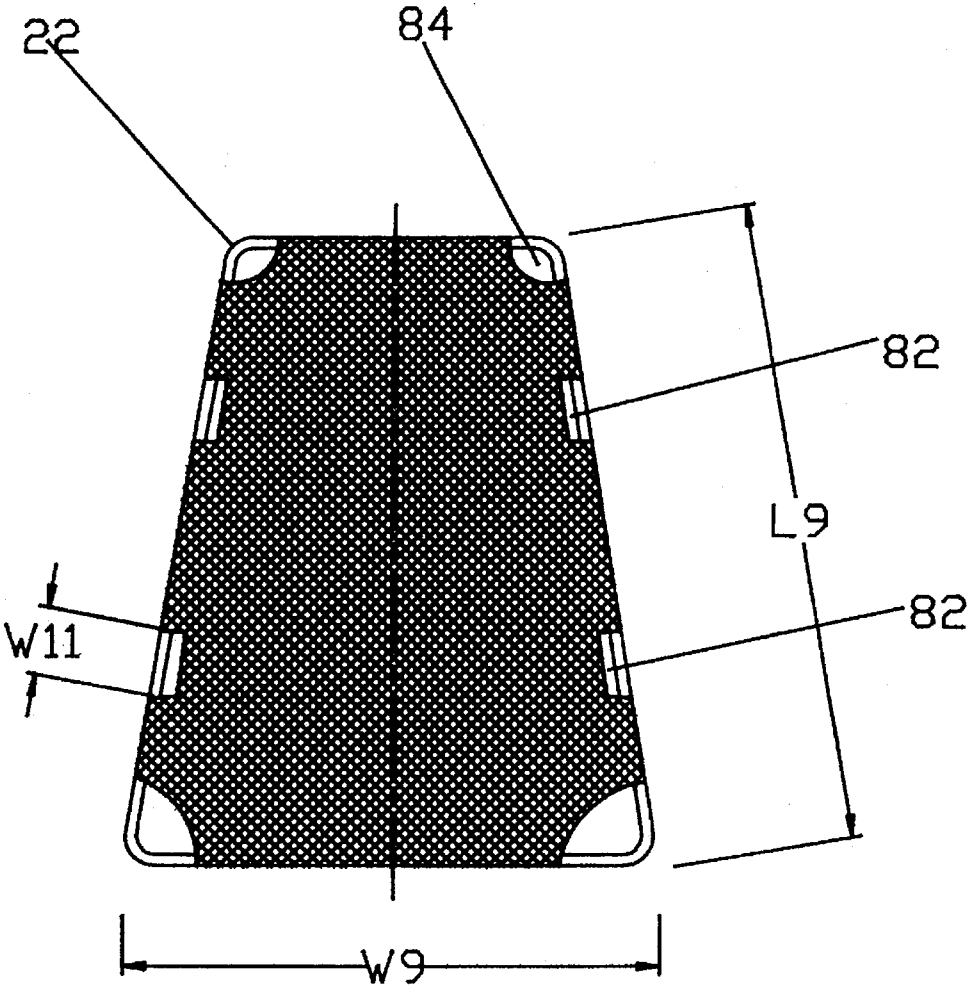
FIG. 8 shows the fabric canopy of FIG. 6 attached to the constructed canopy frame of FIG. 7.
Figure 7:
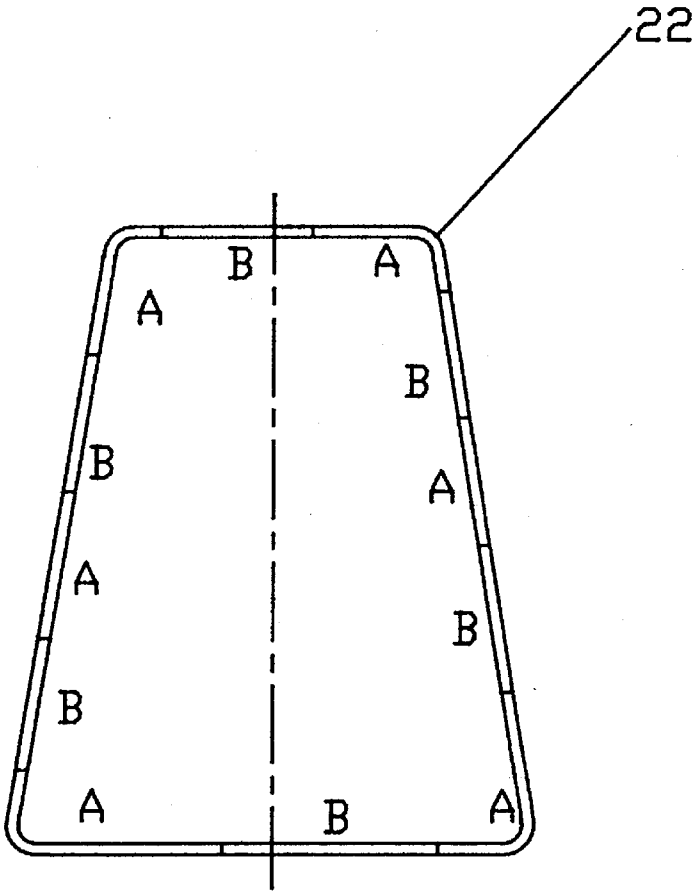
FIG. 7 shows an example of a constructed canopy frame.

Referring now to FIG. 7, a completed frame 22 is shown with the alternating pieces of diametric size A and diametric size B interlinked together to form the completed frame. FIG. 8 shows the canopy fabric 81 as attached to the frame 22. The cutouts 82 for attachment of the vertical support bars and fixtures indicate a sufficient width W11 to allow adjustment for different automobile wheelbases. The length L9 and width W10 are as before.

Figure 9:
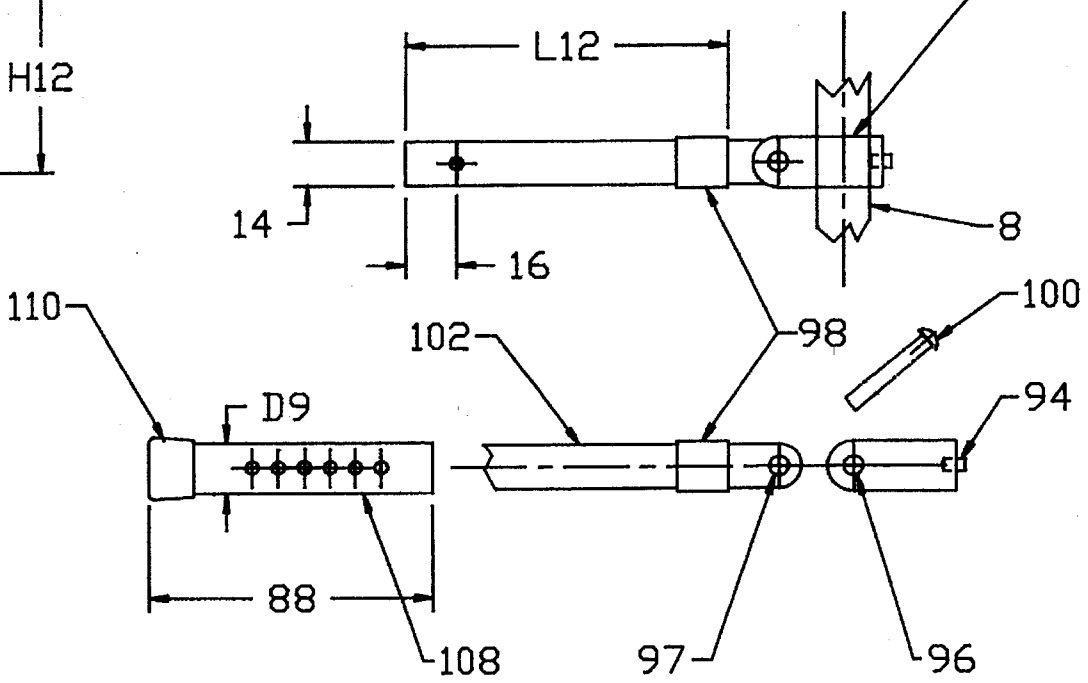
FIG. 9 shows an exploded view of one of the cross-support braces which are used to maintain separation between the automobile and the vertical support bar.

FIG. 9 shows an example of a detailed embodiment of the cross-support brace 32 as shown in FIG. 1. As detailed above, this brace is used to stabilize the vertical support bars against the wheel of the vehicle, thus eliminating any need for external stakes or guide wires or guidelines. The brace 32 consists of an attachment bracket, or collar, or fitting, 92 which slips over, or around, component 8 of the vertical support bar. The bracket must adjustably slide up and down component bar 8. A locking screw plug in the back of the bracket 92 allows the bracket to be securely, yet releasably, positioned at a certain height on vertical bar 8 according to the height of the sheltered vehicle's tires. The bracket 92 further includes a mounting hole 98 for receiving an attachment bracket 98 which has its own corresponding attachment hole 97.

The attachment bracket 98 supports a tubular member 102 of diameter D8 and length L12. A spring loaded button, or pin, 106 is located a distance L10 from the unattached end of the tubular member 102. A second tubular member 108 of diameter D9 and length L11 has a series of holes 104 which penetrate one side of the tubular member 108. One end of the tubular member 108 is capped by non-abrasive butt sleeve 110. The uncapped end of the tubular member 108 has a diameter D9 which is slightly larger than diameter D8, so that member 108 slips over and slides back and forth across tubular member 102, when the button 106 has been appropriately depressed. Tubular member 108 is releasably held in place when a hole 104 allows the button 106 to spring outward and penetrate the hole. This spring loaded button arrangement allows for quick horizontal adjustment of the tubular member 108.

The attachment bracket 98 is secured onto the mounting bracket 92 by aligning the mounting holes 96 and 97 and securing the parts together with an attachment means such as the screw 100 shown. Alternatively, if the hole 96 of the bracket 92 is unthreaded a nut/bolt combination, or a locking pin, might instead be used.

Figure 9A:
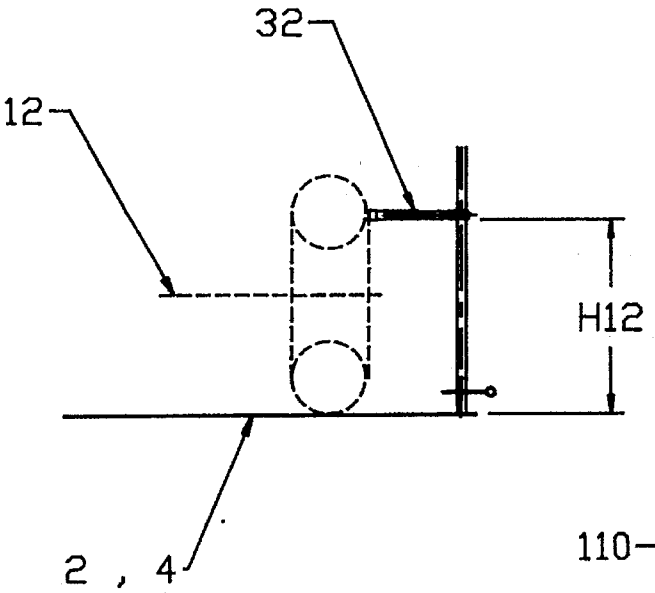
FIG. 9A shows a front view of a horizontally mounted support brace as butted against the wheel of a sheltered vehicle.

As shown in FIG. 9A, the brace 32 is horizontally mounted, at or near perpendicular to the vertical support bar. Moreover, the brace 32 is oriented at a height H12 so that the butt sleeve 110 will encounter and butt against the tire of a sheltered vehicle. This is additionally accomplished by adjusting the extension of the tubular members 108 and 102 via the spring loaded pin 106 to encounter different holes 14 as needed. Once each brace 32 is secured against each tire, then each vertical support bar is prevented from laterally swaying. This in turn prevents the shelter structure from touching the sides or the vehicle in windy conditions. More importantly, this added stability prevents the shelter structure from totally collapsing down upon and damaging the sheltered vehicle.

As shown, the adjustability of the vertical support bars and cross support braces has been implemented through a series of holes for securing one part that telescopes into another part, either through spring loaded buttons, or bolt/nut combinations, or locking pins. However, other means might also be used, such as but not limited to, graduated threads which connect the inner and outer telescoping parts, a releasable clamp between the sliding parts, and/or a ratcheted channel with a spring loaded catch. Each instance would similarly allow releasable extension and retraction of the joined component parts.

Also, while the adjustability of the base plates, via the slidable canopy fixtures, to accommodate various wheelbases of sheltered vehicles has been described, the overall width of the structure might also easily be made adjustable. By providing a plurality of holes in the base sub-plates, the overall width of the base plate could be varied by overlapping the sub-plates further as needed. To similarly accommodate this change in base width, the widthwise components of the canopy frame could also include yet another series of holes further inward on a larger diametered part. Referring again to FIG. 5, these extra holes 130 would allow the width of the canopy frame to be adjustable. Referring again to FIG. 6, the canopy fabric 81 would include further VELCRO attachment points 131 as needed to keep the mounted fabric taunt.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What is claimed is:

1. An adjustable automobile shelter for providing stable and multi-directional shielding from meteorological conditions in a highly portable unit which disassembles into a compact package, said shelter comprising:

at least a pair of base support plates;

at least four vertical support bars, each bar having a top and bottom end, with each bar being independently adjustable in height;

a means for releasably attaching said support bars to said support plates;

a canopy support frame;

at least four fixtures which slidably attach to said support frame and which releasably attach to said vertical support bars;

a detachable fabric canopy which attaches to said support frame, but provides openings for said slidable fixtures;

a plurality of cross-support braces which mount at adjustable heights to said vertical support bars and which adjustably extend to abut each said vertical support bar against a tire of an automobile.

2. The adjustable automobile shelter of claim 1, wherein said base support plate divides into at least two sub-plates which are releasably joined via an attachment means.

3. The adjustable automobile shelter of claim 1, wherein said canopy support frame divides into a set of interfacable component parts which can be releasably attached via an interlocking means to form a rectangular support frame.

4. The adjustable automobile shelter of claim 3, wherein said interfacable component parts include tubular corner members and tubular bar members which alternate in diametric size so that each smaller diametered part will fit into the next subsequent larger diametered part which will then receive the next subsequent smaller diametered part until said parts form a rectangular support frame attached together via an interlocking means.

5. The adjustable automobile shelter of claim 4, wherein said interlocking means of said larger and smaller diametric parts includes through holes in the ends of each part which are aligned to receive a joining mechanism means.

6. The adjustable automobile shelter of claim 4, wherein said interlocking means includes spring loaded button means in the ends of said smaller diametric parts and said larger diametric parts each include holes through one side of said tubular parts, whereby said button means is depressed and said smaller diametric part is inserted into said larger diametric part and said parts releasably interlock when said button means springs forward upon encountering and penetrating said through hole.

7. The adjustable automobile shelter of claim 3, wherein said component parts are non-circular is cross-sectional shape.

8. The adjustable automobile shelter of claim 1, wherein said detachable fabric canopy releasably attaches to said support frame via VELCRO attachment strips which are integrated into attachment flaps of said canopy fabric.

9. The adjustable automobile shelter of claim 1, wherein said support bar attachment means includes a vertically oriented post extending from said base plate for insertion into the bottom end of said support bar, said post having a through hole which aligns with a corresponding through hole in said support bar, whereby an attachment means is used to penetrate said aligned holes and releasably join said support bar with said base plate.

10. The adjustable automobile shelter of claim 1, wherein said support bar attachment means includes a vertically oriented receiving bracket attached to and extending from said base plate for receiving the bottom end of said support bar, said bracket having a through hole which aligns with a corresponding through hole in said support bar, whereby an attachment means is used to penetrate said aligned holes and releasably join said support bar with said base plate.

11. The adjustable automobile shelter of claim 1, wherein said vertical support bars are telescopically adjustable.

12. The adjustable automobile shelter of claim 11, wherein said telescopically adjustable vertical support bars include a first tubular bar with a larger diameter than and a second tubular bar, said first and second bars each having a top and bottom end, said top end of said first bar having a plurality of holes through one side of said tubular bar and said bottom end of said second tubular bar having a spring loaded button, whereby said button is depressed to allow said bottom end of said second bar to be slidably inserted into said top end of said first bar, with said first and second bars becoming releasably attached when said button is maneuvered to encounter and penetrate said holes of said first bar.

13. The adjustable automobile shelter of claim 12, wherein said support bars are non-tubular in shape, yet telescopically slide within each other for adjustability.

14. The adjustable automobile shelter of claim 1, wherein said cross support braces include:

a mounting bracket for slidably attaching and releasably affixing said support brace to said vertical support bar at a height equal to the wheel of the sheltered automobile;

a first tubular member with a smaller diameter than a second tubular member, both members having ends proximal and distal to said mounting bracket, said first tubular member having a spring loaded button means in its distal end, said second tubular member having a plurality of holes penetrating one side of said tubular member and along its length, and second distal end of said second tubular member being capped with a butting sleeve;

an attachment bracket which is attached to said proximal end of said first tubular member for releasably attaching to said mounting bracket via an attachment means;

whereby said button is depressed and said distal end of said first tubular member is slidably inserted into said proximal end of said second tubular member and said members are releasably joined when said button is maneuvered to encounter and penetrate one of said holes, the length of said cross support brace being thereby adjusted to establish contact between the wheel and said butting sleeve, said cross support brace securely bracing said vertical support bar against the wheel of the sheltered vehicle.

15. The adjustable automobile shelter of claim 14, wherein said support members are non-tubular in shape, yet telescopically slide within each other for adjustability.

16. The adjustable automobile shelter of claim 1, wherein said fixtures include "tee" shaped devices with a head for slidably attaching to said canopy frame and a downward extending member for releasably attaching to said top of said vertical support bar via an attachment means.

17. The adjustable automobile shelter of claim 16, wherein said downward extending member has a top and bottom end and is tubular with a diameter smaller than said top of said vertical support bar, said member including a spring loaded button means near its bottom end, said support bar including a hole near its top end, whereby said button is depressed and said member is inserted into said vertical support bar and said member and bar are releasably attached when said button is maneuvered to encounter and penetrate said hole.

18. The adjustable automobile shelter of claim 17, wherein said downwardly extending member is non-tubular in shape.

19. The adjustable automobile shelter of claim 17, wherein said downwardly extending member is larger is diameter than said vertical support bar and said spring loaded button means is located on said bar with a corresponding receiving hole in said member.

20. An adjustable automobile shelter for providing stable and multi-directional shielding from meteorological conditions in a highly portable unit which disassembles into a compact package, said shelter comprising:

a pair of base support plates, each including two component parts which are joined with a releasable attachment means;

four vertical support bars, each bar having a top and bottom end, with each multi-component bar being independently and telescopically adjustable in height;

a means for releasably attaching said support bars to said support plates;

a multi-component canopy support frame which can be assembled and disassembled via releasable interconnection of said component parts;

at least four fixtures which slidably attach to said support frame and which releasably attach to said vertical support bars;

a detachable fabric canopy which attaches to said support frame, yet provides openings for attaching and sliding of said slidable fixtures;

a plurality of cross-support braces which slidably mount and releasably attach to said vertical support bars and are positionable at the same general height as the tires of a sheltered automobile, said braces adjustably extending in length to abut each said vertical support bar against a tire of said automobile.

* * * * *